United States Patent [19]

Maruta

[11] 4,329,207

[45] May 11, 1982

[54] NEUTRAL TIN ELECTROPLATING BATHS

[75] Inventor: Masatosi Maruta, Yokohama, Japan

[73] Assignee: Kizai Kabushiki Kaisha, Tokyo, Japan

[21] Appl. No.: 195,446

[22] Filed: Oct. 9, 1980

[30] Foreign Application Priority Data

Feb. 21, 1980 [JP] Japan ..... 55-19737

[51] Int. Cl.[3] ..... C25D 3/32

[52] U.S. Cl. ..... 204/54 L; 204/54 R

[58] Field of Search ..... 204/54 R, 54 L, 43 S

[56] References Cited

FOREIGN PATENT DOCUMENTS 52-66832 6/1977 Japan ..... 204/43 S 308099 7/1971 U.S.S.R. ..... 204/43 S

OTHER PUBLICATIONS

Vasanta Sree et al., Bull. India Sect. Electrochem, Soc., 9, 13–14, (1960).

*Primary Examiner*—G. L. Kaplan

*Attorney, Agent, or Firm*—Jordan and Hamburg

[57] ABSTRACT

A neutral tin electroplating bath for obtaining a compact tin coating, comprising a stannous salt, an alkali metal salt of pyrophosphoric acid, a polyhydric phenol, a surface-active agent and, if desired, at least one additive selected from the group consisting of hydrazine, hypophosphorous acid, phosphous acid, ascorbic acid, formaldehyde and salts thereof.

4 Claims, No Drawings

NEUTRAL TIN ELECTROPLATING BATHS

This invention relates to a neutral aqueous tin electroplating bath. More particularly, it relates to a neutral tin electroplating bath characterized in that it is obtained by incorporating a fundamental plating bath containing a stannous salt and an alkali metal salt of pyrophosphoric acid as the main components with a polyhydric phenol and a surface-active agent, which raise the current efficiency to obtain compact coatings, and with, if desired, at least one additive selected from hydrazine, hypophosphorous acid, phosphorous acid, ascorbic acid, formaldehyde and/or a salt thereof.

As a tin electroplating bath, there have heretofore been mainly used acid baths such as sulphuric and borofluoric acid baths, and alkali baths such as a sodium stannate bath. However, the sulphuric acid of a high concentration and the surface active agent contained in the sulphuric acid bath as well as the fluoride contained in the borofluoric acid bath will raise problems as to drainage disposal and operational environments. The alkali baths are such that workers are particularly required to keep them out of the harm thereof for the sake of safety. Thus, neither the acid baths nor the alkali baths are considered to be preferable baths from the view-point of prevention of environmental pollution.

It is customary to use an amine-aldehyde type brightener in the sulphuric acid baths. These baths are advantageous in that they are satisfactory in electrical conductivity and current efficiency and are operative even at room temperature; on the other hand, they are unsatisfactory in throwing power, require a cooling unit in summer because of a narrow range of temperature needed for bright electroplating and require a cathode rocker to obtain an electroplating having uniform appearance. In addition, they are disadvantageous in that the service life thereof is short since the brightener produces decomposed products.

Alkaline tin electroplating baths using a stannate therein are disadvantageous in that they will not easily produce a thick electroplating because of their poor current efficiency, they are strongly alkaline and apt to attack substrates to be electroplated because of their use at a high temperature of 60°–80° C. and they require troublesome management thereof (such as frequent replenishment of the fresh components of the bath) and troublesome treatment of the anode (such as the formation of a coating on the anode to ensure the dissolution thereof in the form of tetravalent tin ion) because of the use of sodium hydroxide or potassium hydroxide in the bath.

It has recently been sought that parts for electronic industrial use in which insulating parts made of glass, ceramics or plastics are integrally assembled with electroplated articles, be covered with a tin electroplating which is excellent in rust resistance, solderability and close adhesiveness without corrosion, deformation, discoloration and change in quality. However, acidic baths and alkali baths are not preferable baths for the reason that these baths will have adverse effects on glass, ceramics, plastics or the like at the time of electroplating since the acidic baths are strongly acidic (pH value of lower than 1) and the alkali baths are strongly alkaline (pH value of 14).

There have recently been filed Japanese applications for patents on inventions relating to neutral or weakly alkaline tin electroplating baths using therein a pyrophosphate as a complexing agent, the patent applications being exemplified by Japanese Patent Publications Nos. 48-29457, 54-6019 and Japanese Patent Kokai (Laid Open) No. 53-124131. The electroplating baths so published will not easily give compact electroplatings with satisfactory current efficiency since they contain organic materials, such as gelatin, which will easily degrade them. Further, these plating baths are disadvantageous in that they may not easily be adjusted since the additives contained therein are sparingly soluble in water and will not give pure tin platings since they contain other metallic ions.

An object of this invention is to provide substantially neutral tin electroplating baths which eliminate the aforesaid drawbacks and will give compact films or coatings. As compared with the conventional acidic or alkaline plating baths, the tin plating baths of this invention may be easily subjected to drainage disposal, will give smooth compact white-colored semi-bright platings having neither pits nor pinholes and will have no adverse effects on platings formed on glass- and ceramics-composite materials for use as parts of communicating machines and parts of electronic industrial manufactures.

The substantially neutral tin plating bath of this invention comprises water, a divalent tin salt as a supply source of tin ion, a pyrophosphoric acid-alkali metal salt which facilitates dissolution of the tin salt in the aqueous solution to increase the electrical conductivity of the bath, a polyhydric phenol which increases the velocity of deposition of tin and the leveling of the resulting tin coating, and a surface-active agent which inhibits the formation of a dendritic and spongy tin coating and prevents the formation of pits. In addition to these components, at least one member selected from the group consisting of hydrazine, hypophosphorous acid, phosphorous acid, ascorbic acid, formaldehyde and the salts thereof, may be added if necessary; these compounds are useful in preventing the oxidation of divalent tin, enhancing the leveling particularly at high current portions and improving the dissolution of the anode.

The stannous salts which may be used in this invention may include stannous chloride, stannous sulphate, stannous pyrophosphate, stannous oxide and stannous acetate. These stannous salts may be used in an amount of 6–60 g/l, preferably 12–35 g/l, calculated as metallic tin. The use of less than 6 g/l, calculated as metallic tin, will exhibit an unsatisfactory current efficiency and an unsatisfactory electrical conductivity, while the use of more than 60 g/l, calculated as metallic tin, will disadvantageously decrease the solubility of the surface-active agent and increase the loss of tin by carry-over of the solution with the plated articles withdrawn.

The alkali metal salts of pyrophosphoric acid used herein may preferably include potassium pyrophosphate and sodium pyrophosphate. These salts may preferably be used in an amount 1.5–3 times as the molality of the stannous salt (the amount being about 13–261 g/l, calculated as pyrophosphoric ion); the use of the salt in an amount less than 1.5 times as said molality will render it difficult to complex and dissolve the stannous salt, while the use of more than 3 times will not be significantly further effective, this being economically disadvantageous.

The polyhydric phenols used herein may preferably include catechol, resorcine and hydroquinone having two OH groups positioned respectively at ortho-, meta- and para-position on the benzene nucleus, as well as pyrogallol and phloroglucine each having three OH groups. These polyhydric phenols may be used alone or in combination. They permit the current density for obtaining a uniformly thick coating to be in a broad range and are effective in enhancing current efficiency. The current efficiency will increase with the increase in amount of the polyhydric phenol or phenols. For example, in a case where a tin plating bath comprising 0.15 mol of stannous chloride and 0.3 mol of potassium pyrophosphate as the additives is used for plating at a temperature of 50° C. and a current density of 1 A/dm$^2$ without the addition of the polyhydric phenol, the current efficiency is 4% which is very low. On the other hand, the addition of 0.5 g/l of catechol as a polyhydric phenol to the above plating bath will raise the current efficiency to 52%; further, the addition of 1 g/l, the addition of 3 g/l and the addition of 5 g/l will raise the current efficiency to 75%, 93% and 100%, respectively. The current efficiency in a bath will vary depending on the temperature and current density therein, and it is higher as the temperature is higher while it is lower as the current density is higher. The concentration of the polyhydric phenol used in a bath can be determined depending on the bath temperature and the current density used, and it may preferably be in the range of 0.5–20 g/l.

The surface-active agent used herein is effective in depositing a metal in the finely particulate form thereby to obtain a compact plating and is also effective in enabling the current density to be used in a wide range. The anionic surface-active agents may preferably include a polyoxyethylene and an alkyl ether sodium sulphate. The polyoxyethylenes may preferably be dimer to tetramer of ethylene oxide. The non-ionic surface-active agents may include polyethylene glycol alcohol ethers, polyethylene glycol alkylphenol ethers, polyethylene glycol fatty acid esters and adducts of polypropylene glycol with ethylene oxide. The number of mols of ethylene oxide added may preferably be at least 8, and, if it is less than 8 then the adduct will be poorly water-soluble. The cationic surface-active agents may preferably include adducts of a higher aliphatic amine or aliphatic amide with ethylene oxide, and, the number of mols of ethylene oxide added may preferably be at least 8. These surface-active agents may be used alone or in combination and may be used in an amount of 0.5–30 g/l, preferably 1–10 g/l. The use of less than 0.5 g/l is not fully effective in giving compact plates, while the use of more than 30 g/l is not desirable since the bath is made remarkable foamable although no problems are raised as to the properties of the resulting electroplatings.

Hydrazine, hypophosphorous acid, phosphorous acid, ascorbic acid, formaldehyde and salts thereof may be used alone or in combination whereby not only the oxidation of the divalent tin is prevented, but also the formation of a dendritic tin coating at the high electric current portions is inhibited thereby obtaining compact electroplatings. Further, these additives are useful in preventing the tin anode from being made inert and in enhancing the electrical conductivity of the bath. Hydrazine and salts thereof are excellently useful in these regards and, in addition, form a complex salt with tin, the complex salt being useful as an auxiliary complexing agent for pyrophosphate thereby making the bath stable over a wide range of pH. The additives may be used in an amount of 5–100 g/l, preferably 10–50 g/l. The use of less than 5 g/l will be less effective, while the use of 100 g/l will not further be effective.

In the practice of plating using the tin plating bath of this invention, the pH value of the bath may be in the range of 6.0–9.5, preferably 7.5–8.5. The use of the bath at a pH value of less than 6.0 will permit the pyrophosphoric acid to be rapidly decomposed, while the use thereof at a pH value of more than 9.5 will not easily give compact platings or coatings. It is suitable to use potassium hydroxide, sodium hydroxide, chloral hydrate or the like in order to raise the pH, while it is suitable to use polyphosphoric acid, pyrophosphoric acid, hydrochloric acid, sulphuric acid, phosphoric acid, citric acid, tartaric acid or the like in order to lower the pH.

The current density used in this invention may be in the range of 0.1–10 A/dm$^2$, preferably 1–3 A/dm$^2$.

The temperature of the bath used herein may be in the range of 15°–60° C., preferably 30°–50° C.

Agitation of the bath is not particularly necessary and satisfactory platings may be obtained from the bath in the stationary state. It is desirable, however, to effect agitation of the bath by the use of a cathode rocker or the like in a case where plating is effected at a high electric current density.

This invention will be better understood by the following non-limitative Examples and Comparative Examples.

EXAMPLE 1

There was prepared an aqueous plating bath comprising the following components:

| | |
|---|---|
| Stannous sulphate | 30 g/l |
| Potassium pyrophosphate | 120 g/l |
| Pyrogallol | 5 g/l |
| Polyethylene glycol nonylphenol ether (No. of mols of ethylene oxide added: 20) | 3 g/l |
| pH (adjusted with sulphuric acid) | 8.0 |

A copper plate was electroplated in the thus prepared plating bath at a temperature of 50° C. and a current density of 1 A/dm$^2$ for 5 minutes thereby to obtain a smooth compact white-colored and semi-bright plating or coating on the copper plate. The coating had a thickness of 2.5$\mu$ and the current efficiency was 100%.

EXAMPLE 2

There was prepared a plating bath comprising the following components:

| | |
|---|---|
| Stannous chloride dihydrate | 45 g/l |
| Potassium pyrophosphate | 130 g/l |
| Catechol | 1 g/l |
| Polyethylene glycol lauryl ether sodium sulphate (No. of mols of ethylene oxide added: 4) | 5 g/l |
| Ascorbic acid | 30 g/l |
| pH (adjusted with potassium hydroxide) | 8.0 |

The plating bath so prepared was used to electroplate a steel plate therein at a temperature of 50° C. and a current density of 0.5 A/dm$^2$ for 10 minutes to obtain a smooth compact white-colored and semi-bright tin coating on the steel plate. The coating had a thickness of 2.3$\mu$ and the current efficiency was 91%.

EXAMPLE 3

There was prepared a plating bath comprising the following components:

| | |
|---|---|
| Stannous sulphate | 22 g/l |
| Sodium pyrophosphate | 55 g/l |
| Hydroquinone | 5 g/l |
| Pyrogallol | 1 g/l |
| Polyethylene glycol nonylphenol ether (No. of mols of ethylene oxide added: 14) | 2 g/l |
| Sodium hypophosphite | 40 g/l |
| pH (adjusted with polyphosphate) | 7.5 |

The plating bath so prepared was used to electroplate a copper-plated brass plate therein at a temperature of 40° C. and a current density of 2 A/dm$^2$ for 10 minutes thereby to obtain a smooth compact white-colored and semi-bright coating. The thickness of the coating so obtained was 7.6$\mu$ and the current efficiency was 75%.

COMPARATIVE EXAMPLE 1

There was prepared a plating bath comprising the following components:

| | |
|---|---|
| Stannous chloride dihydrate | 34 g/l |
| Potassium pyrophosphate | 100 g/l |
| Polyethylene glycol lauric acid monoester (No. of mols of ethylene oxide added: 20) | 3 g/l |
| Hydrazine hydrochloride | 35 g/l |
| pH (Adjusted with potassium hydroxide) | 8.0 |

The plating bath so prepared was used to electroplate a steel plate therein at a temperature of 50° C. and at a current density of 1 A/dm$^2$ for 5 minutes to obtain a coating on the steel plate. The coating so obtained did not have a satisfactory smooth surface and a thickness of 0.1$\mu$ and the current efficiency was 4% which was very unsatisfactory.

EXAMPLE 4

There was prepared a plating bath comprising the following ingredients:

| | |
|---|---|
| Stannous pyrophosphate | 62 g/l |
| Potassium pyrophosphate | 100 g/l |
| Resorcine | 10 g/l |
| Catechol | 2 g/l |
| Polyethylene glycol cetyl alcohol ether (No. of mols of ethylene oxide added: 12) | 1 g/l |
| Hydrazine hydrate | 20 g/l |
| pH (Adjusted with citric acid) | 8.5 |

The plating bath so prepared was used to electroplate a copper plate therein at a temperature of 30° C. and a current density of 1 A/dm$^2$ for 10 minutes thereby obtaining a smooth compact white-colored and semi-bright coating on the copper plate. The thickness of the coating so obtained was 4.1$\mu$ and the current efficiency was 80%.

EXAMPLE 5

There were prepared a plating bath comprising the following components:

| | |
|---|---|
| Stannous oxide | 40 g/l |
| Sodium pyrophosphate | 160 g/l |
| Pyrogallol | 4 g/l |
| Polyethylene glycol octadecyl amine (No. of mols of ethylene oxide added: 15) | 4 g/l |
| Phosphorous acid | 20 g/l |
| pH (Adjusted with hydrazine hydrate) | 8.5 |

The plating bath so prepared was used to electroplate a steel plate therein at a temperature of 50° C. and a current density of 4 A/dm$^2$ for 3 minutes thereby to obtain a smooth compact white-colored and semi-bright coating on the steel plate. The coating so obtained had a thickness of 3.7$\mu$ and the current density was 60%.

COMPARATIVE EXAMPLE 2

There was prepared a plating bath comprising the following components:

| | |
|---|---|
| Stannous sulphate | 54 g/l |
| Sodium pyrophosphate | 140 g/l |
| Catechol | 3 g/l |
| Hydrazine hydrochloride | 50 g/l |
| pH (Adjusted with sodium hydroxide) | 9.0 |

The plating bath so prepared was used to electroplate a copper plate therein at a temperature of 40° C. and a current density of 3 A/dm$^2$ for 5 minutes to obtain a coating on the copper plate. The thus obtained coating had an undesirable spongy appearance without brightness.

EXAMPLE 6

There was prepared a plating bath comprising the following components:

| | |
|---|---|
| Stannous chloride dihydrate | 70 g/l |
| Potassium pyrophosphate | 200 g/l |
| Phloroglucine | 2 g/l |
| Pyrogallol | 1 g/l |
| Polyethylene glycol octylphenol ether (No. of mols of ethylene oxide added: 40) | 10 g/l |
| Hydrazine sulphate | 15 g/l |
| pH (Adjusted with potassium hydroxide) | 8.0 |

The plating bath so prepared was used to electroplate a copper plate therein at a temperature of 50° C. and a current density of 3 A/dm$^2$ for 5 minutes to obtain a smooth compact white-colored and semi-bright coating on the copper plate. The thus obtained coating had a thickness of 6.2$\mu$ and the current efficiency was 82%.

As mentioned above, there may be obtained smooth compact white-colored semi-bright coatings from a neutral tin electroplating bath of this invention comprising a stannous salt, an alkali metal salt of pyrophosphoric acid, a polyhydric phenol, a surface-active agent and, if desired, at least one member selected from the group consisting of hydrazine, hypophosphorous acid, phosphorous acid, ascorbic acid, formaldehyde and salts thereof. In addition, the plating baths of this invention are applicable to plating of communication machine parts or electronic industrial parts without having adverse effects on the platings of glass- or ceramics-composite materials therein.

What is claimed is:

1. A substantially neutral aqueous tin electroplating bath at a pH value of 6.0–9.5 consisting of a stannous salt, an alkali metal salt of pyrophosphoric acid, a polyhydric phenol and a surface-active agent.

2. A substantially neutral aqueous tin electroplating bath at a pH value of 6.0–9.5 consisting of a stannous salt, an alkali metal salt of pyrophosphoric acid, a polyhydric phenol, a surface-active agent and at least one additive selected from the group consisting of hydrazine, hypophosphorous acid, phosphorous acid, ascorbic acid, formaldehyde and salts thereof.

3. A substantially neutral tin electroplating bath according to claim 2, wherein the stannous salt, alkali metal salt of pyrophosphoric acid, polyhydric phenol and surface-active agent and the additive are present in amounts of 6–60 g/l, 13–270 g/l, 0.5–20 g/l, 0.5–30 g/l and 5–100 g/l, respectively.

4. A substantially neutral tin electroplating bath according to claim 1 or 2, wherein the stannous salt, alkali metal salt of pyrophosphoric acid, polyhydric phenol and surface-active agent are present in amounts of 6–60 g/l, 13–270 g/l, 0.5–20 g/l and 0.5–30 g/l, respectively.

* * * * *